US007252688B2

(12) United States Patent
Tashiro et al.

(10) Patent No.: US 7,252,688 B2
(45) Date of Patent: Aug. 7, 2007

(54) DECOLORIZATION APPARATUS AND DECOLORIZATION METHOD FOR TEXTILE PRODUCT

(75) Inventors: Takehisa Tashiro, Kurashiki (JP); Kakuji Miyahara, Kurashiki (JP); Toyoteru Ando, Kurashiki (JP); Katsuhiro Nishikura, Mattho (JP); Masatoshi Shinbashi, Mattho (JP)

(73) Assignee: Howa Kabushiki Kaisha, Kurashiki-Shi (JP)

( * ) Notice: Subject to any disclaimer, the term of this patent is extended or adjusted under 35 U.S.C. 154(b) by 0 days.

(21) Appl. No.: 10/989,901

(22) Filed: Nov. 16, 2004

(65) Prior Publication Data

US 2005/0115004 A1 Jun. 2, 2005

Related U.S. Application Data

(63) Continuation of application No. PCT/JP02/04817, filed on May 17, 2002.

(51) Int. Cl.
*D06B 5/12* (2006.01)

(52) U.S. Cl. ..... 8/149.1; 8/149.2; 68/5 C

(58) Field of Classification Search ..... None
See application file for complete search history.

(56) References Cited

U.S. PATENT DOCUMENTS 1,550,518 A * 8/1925 Donk et al. ..... 8/108.1
2,712,183 A * 7/1955 Jorgenson ..... 34/131
2,957,330 A * 10/1960 Cline ..... 68/20
3,065,620 A * 11/1962 Houser ..... 68/13 R
3,078,702 A * 2/1963 Conlee ..... 68/20
3,130,570 A * 4/1964 Rentzepis ..... 68/13 R
3,226,842 A * 1/1966 Morey ..... 34/72
4,182,050 A * 1/1980 Righi ..... 34/60
5,006,124 A * 4/1991 Tieckelmann et al. ..... 8/111
5,107,606 A * 4/1992 Tsubaki et al. ..... 34/596
5,313,811 A * 5/1994 Wasinger et al. ..... 68/5 C
5,366,510 A * 11/1994 Wasinger et al. ..... 8/110
5,404,732 A * 4/1995 Kim ..... 68/13 R
5,471,692 A * 12/1995 Wasinger et al. ..... 8/159
5,611,816 A * 3/1997 Wasinger ..... 8/102
5,613,983 A * 3/1997 Terry et al. ..... 8/102
5,625,915 A * 5/1997 Radler et al. ..... 8/158
5,653,129 A * 8/1997 Jang ..... 68/13 R
5,688,289 A * 11/1997 Nishioka et al. ..... 8/137

(Continued)

FOREIGN PATENT DOCUMENTS

DE 195 46 075 A1 1/1997

(Continued)

*Primary Examiner*—Frankie L. Stinson
(74) *Attorney, Agent, or Firm*—Burr & Brown

(57) ABSTRACT

The present invention provides an apparatus suitable for decolorizing a textile product using ozone. The apparatus of the present invention enables the decolorization rate to be adjusted by adjusting the water content of the textile product and controlling the ozone concentration to achieve uniform decolorization. The decolorization apparatus for a textile product of the present invention includes an airtight container, a rotary drum which rotates in the airtight container, an ozone generator connected with the airtight container through an automatic valve, a water supply unit, and a blower unit which includes an air heater and supplies hot air and cool air to the airtight container. The ozone concentration inside the airtight container is maintained at a desired level by measuring the ozone concentration using an ozone analyzer and controlling the ozone generator.

8 Claims, 4 Drawing Sheets

U.S. PATENT DOCUMENTS

| | | | | | |
|---|---|---|---|---|---|
| 5,765,403 | A | * | 6/1998 | Lincoln et al. | 68/13 R |
| 5,940,988 | A | * | 8/1999 | Eisen | 34/596 |
| 5,960,501 | A | * | 10/1999 | Burdick | 8/158 |
| 6,014,766 | A | * | 1/2000 | Nagai et al. | 714/764 |
| 6,024,766 | A | * | 2/2000 | Wasinger | 8/111 |
| 6,460,211 | B1 | * | 10/2002 | Chapman | 8/158 |
| 6,506,309 | B1 | * | 1/2003 | Daniels et al. | 210/760 |
| 6,507,965 | B2 | * | 1/2003 | Kown | 8/158 |
| 6,513,180 | B2 | * | 2/2003 | Hamand | 8/158 |
| 6,571,585 | B1 | * | 6/2003 | Wasinger | 68/5 C |
| 6,598,431 | B2 | * | 7/2003 | Teran et al. | 68/17 R |
| 6,607,672 | B2 | * | 8/2003 | Koslow et al. | 210/748 |
| 6,673,121 | B2 | * | 1/2004 | Mettlach et al. | 8/149.1 |
| 6,691,536 | B2 | * | 2/2004 | Severns et al. | 68/12.27 |
| 6,889,449 | B2 | * | 5/2005 | Silver | 34/490 |
| 2002/0129450 | A1 | * | 9/2002 | Kim | 8/115.51 |

FOREIGN PATENT DOCUMENTS

| | | | | |
|---|---|---|---|---|
| FR | 1.583.274 | | * | 10/1969 |
| FR | 2.059.841 | | * | 6/1971 |
| JP | 04-200588 | A1 | | 7/1992 |
| JP | 4-244198 | | * | 9/1992 |
| JP | 06-212554 | A1 | | 8/1994 |
| JP | 07-011565 | A1 | | 1/1995 |
| JP | 07-037715 | B2 | | 4/1995 |
| JP | 7-144086 | | * | 6/1995 |
| JP | 07-207572 | A1 | | 8/1995 |
| JP | 10-15290 | | * | 1/1998 |
| JP | 2000-233099 | | * | 8/2000 |
| JP | 2001-87590 | | * | 4/2001 |
| JP | 2001-137588 | | * | 5/2001 |
| JP | 2001-187294 | | * | 7/2001 |
| JP | 2002-11273 | | * | 1/2002 |
| JP | 2002-11281 | | * | 1/2002 |
| JP | 2002-105844 | A1 | | 4/2002 |
| WO | WO 95/22647 | A1 | | 8/1995 |
| WO | 01/34894 | A | | 5/2001 |

* cited by examiner

DECOLORIZATION APPARATUS AND DECOLORIZATION METHOD FOR TEXTILE PRODUCT

CROSS REFERENCE TO RELATED APPLICATION

This application is a continuation of International Patent Application No. PCT/JP02/04817, having an international filing date of May 17, 2002, which designated the United States, the entirety of which is incorporated herein by reference.

BACKGROUND OF THE INVENTION

The present invention relates to a decolorization apparatus for a textile product such as a fabric roll and a sewn garment, particularly for a dyed textile product, and to a decolorization method using the apparatus, in which a treatment target textile product is decolorized by exposure to ozone gas.

Conventionally, a textile product such as dyed jeans is partially decolorized to provide the textile product with a decolorization pattern. The partial decolorization of jeans is achieved by a physical method in which a dyed product is loaded into a drum together with pumice and rotated, or by a method using a bleaching agent such as hypochlorite or a hydrogen peroxide aqueous solution.

Japanese Examined Patent Publication (Kokoku) No. 7-37715 discloses a method for forming a decolorization pattern on a textile product by exposing a dyed textile product containing moisture in different amounts to an ozone atmosphere to obtain a decolorization pattern having a decolorization contrast caused by the difference in the amount of moisture. This invention utilizes a phenomenon in which a section rich in moisture is decolorized by ozone to a greater extent than a section with less moisture, and obtains a decolorization pattern having a higher contrast in comparison with the conventional method by providing the textile product with moisture corresponding to a desired pattern. Ozone is supplied by utilizing a commercially available ozone generator using a silent discharge method in which air is used as the feed gas, and the residual ozone is decomposed by using a potassium iodide solution. This invention discloses an embodiment in which a pair of dyed trousers is hung inside a stainless steel cylindrical container with a diameter of 50 cm and a height of 140 cm, and ozone is blown into the container while rotating the trousers.

Japanese Patent Application Laid-open No. 2002-105844 discloses a shape stabilization apparatus which provides a textile product with wrinkle resistance and shrink resistance by applying ammonia gas and treating the textile product with a resin treatment solution which does not contain a formalin component. This apparatus includes an airtight container equipped with an ammonia gas supply pipe, an inert gas supply pipe, and a steam pipe, a rotary drum having an air-permeable peripheral wall which rotates around a horizontal axis inside the airtight container, a treatment solution injection pipe connected with the airtight container, a blower pipe equipped with a heater which supplies hot air and cool air to the airtight container, and a liquid heater for heating the treatment solution.

BRIEF SUMMARY OF THE INVENTION

The present invention provides an apparatus suitable for decolorizing a textile product by using ozone. The apparatus of the present invention enables the decolorization rate to be adjusted by adjusting the water content of a textile product to be treated and controlling the ozone concentration, enables a water content adjustment step and an ozone decolorization step to be continuously performed in a single apparatus, and enables uniform decolorization. A uniform decolorization with freely adjustable decolorization rate is a technical prerequisite for partial decolorization for obtaining a desired decolorization pattern. The present invention also proposes a preferable decolorization method using the apparatus of the present invention.

The decolorization apparatus for a textile product of the present invention includes: an airtight container 1; a rotary drum 2 which has a water-permeable peripheral wall and rotates around a horizontal axis inside the airtight container; a door 12 provided to the airtight container 1 for loading a textile product into the rotary drum; an ozone generator 41 connected with the airtight container through an automatic valve 42; a water supply unit 58 which supplies water to the airtight container; and a blower unit 34 which includes an air heater 31 and supplies hot air and cool air to the airtight container.

The ozone concentration inside the airtight container is maintained at a desired level by measuring the ozone concentration using an ozone analyzer 43 and controlling the amount of ozone generated by the ozone generator 41 based on a value detected by the ozone analyzer.

The decolorization method of the present invention includes (1) using an apparatus which includes an airtight container 1 and a rotary drum 2, the airtight container 1 having a door 12 and the rotary drum 2 having a water-permeable peripheral wall and rotating around a horizontal axis in the airtight container; (2) loading a textile product into the rotary drum 2 and closing the door; (3) performing a centrifugal dehydration step of rotating the rotary drum 2 at a high speed; (4) performing an ozone decolorization step of supplying ozone gas to the airtight container 1 and rotating the rotary drum 2 at a low speed, thereby exposing the textile product to the ozone gas to decolorize the textile product; (5) performing an ozone discharging step of discharging the ozone gas by supplying air to the airtight container 1; (6) performing a residual ozone decomposition step of dissolving or decomposing the ozone remaining in the textile product by supplying water and a chemical, as required, to the airtight container 1; and (7) performing a post-treatment washing step of washing the textile product with water and dehydrating the textile product.

The textile product can be uniformly decolorized by performing a semi-drying step of supplying heated air to the airtight container 1 while rotating the rotary drum 2 at a low speed to uniformly adjust the water content of the textile product until a desired water content is reached while disentangling the loaded textile product, between the centrifugal dehydration step and the ozone decolorization step in the above-described method.

It is known that, when a dyed textile product is exposed to ozone at a certain concentration for a certain period of time, the degree (rate) of decolorization varies depending on the content of water remaining in the textile product.

The decolorization apparatus of the present invention is an apparatus which decolorizes a dyed textile product by using ozone, and allows the water content adjustment step and the ozone decolorization step to be continuously performed in a single apparatus. In the water content adjustment step, the water content of the dyed textile product can be easily and uniformly adjusted corresponding to a desired degree or uniformity of decolorization.

Since the apparatus of the present invention includes the rotary drum 2 which rotates inside the airtight container 1, dyeing as a step preceding the decolorization can be performed by supplying a dye solution to the airtight container 1, whereby the water content adjustment step and the ozone decolorization step can be continuously performed in succession to the dyeing step.

The water content of the textile product can be reduced within a short period of time before performing the ozone decolorization by rotating the rotary drum at a high speed to remove water by centrifugal force. When further reducing the water content and attaining a uniform water content, the water content may be reduced to a desired level by blowing hot air generated by a steam heater 31 and a blower 32 into the airtight container 1 after the centrifugal dehydration in a state in which the rotary drum is rotated at a low speed, and adjusting the water content while gently stirring the textile product subjected to the centrifugal dehydration.

The degree of decolorization may be adjusted by controlling the concentration of ozone injected into the container by controlling the discharge of the ozone generator by using a controller. In practice, the amount of ozone generated by the ozone generator is controlled by measuring the ozone concentration inside the airtight container 1 by using an ozone analyzer 43 and performing PID control so that the ozone concentration inside the airtight container is constant during the treatment time. The degree of decolorization may be adjusted by the ozone exposure time. The treatment time is usually about 30 to 60 minutes.

It is preferable to inject and discharge ozone into and from the airtight container 1 from the side or the top of the container 1. According to the experiments conducted by the present inventors, it was found appropriate to inject ozone gas from the side of the airtight container 1 and discharge the residual gas from the top of the container 1, or to inject ozone gas from the top of the airtight container 1 and discharge the residual gas from the side.

Since ozone gas is heavier than air, ozone injected into the airtight container 1 is stirred by the rotation of the rotary drum 2 to present an almost uniform concentration. Uniformity of ozone inside the airtight container can be further improved by providing a blower and circulating and stirring the ozone-containing air inside the container.

A uniform and consistent decolorization can be achieved by adjusting the speed and reverse timing of the rotation of the rotary drum 2 during the ozone decolorization according to the type and loading amount of textile products so that the textile products inside the drum are dispersed and uniformly exposed to ozone.

DETAILED DESCRIPTION OF THE EMBODIMENT

The apparatus and method of the present invention are described below in more detail with reference to the drawings which illustrate an embodiment of the present invention.

Figure 1:
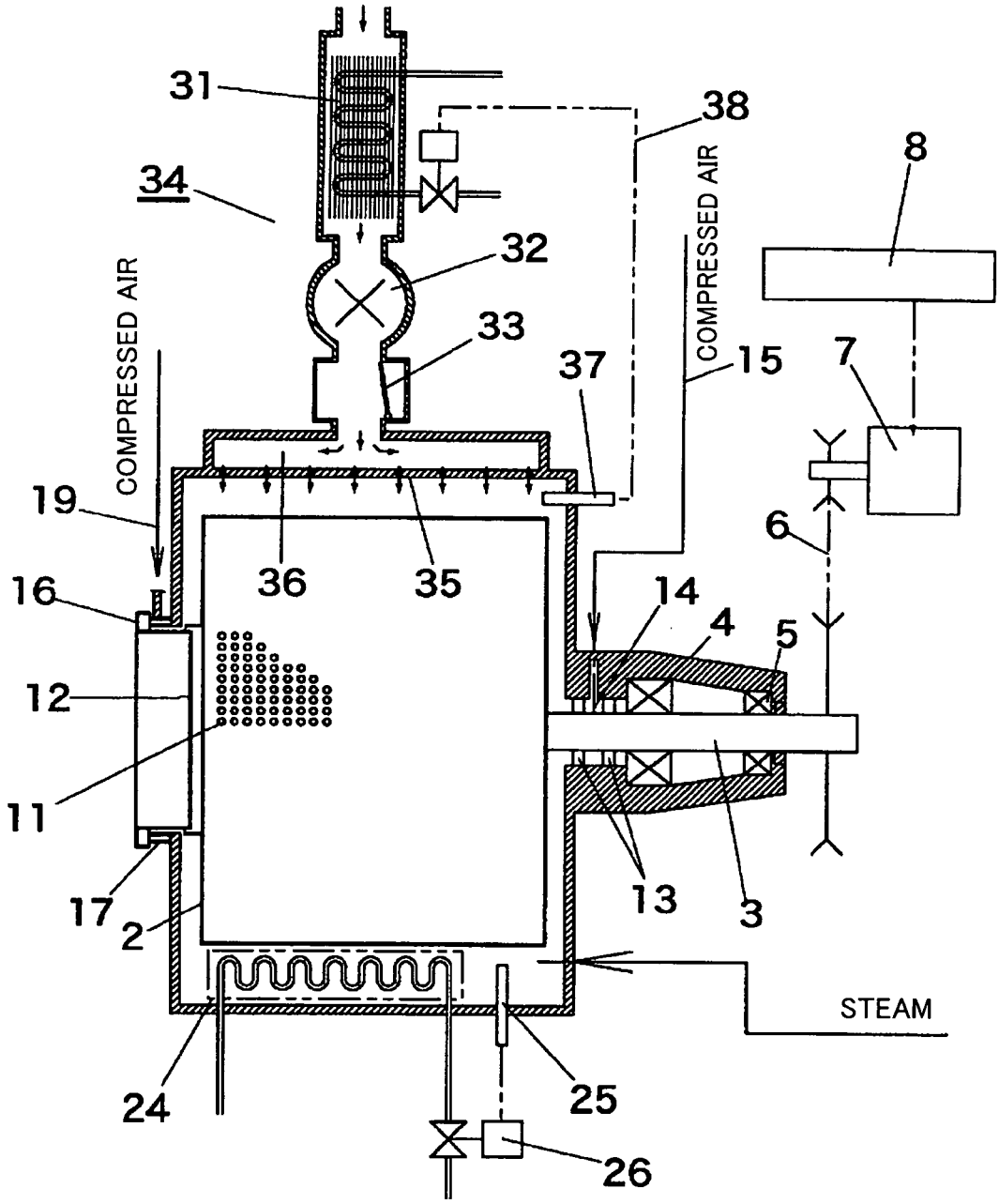
FIG. 1 is a schematic cross-sectional view showing a main portion of an embodiment apparatus of the present invention.

FIG. 1 shows a main portion of an embodiment apparatus. A rotary drum 2 which rotates around a horizontal axis is provided inside an airtight container 1. A rotary shaft 3 of the rotary drum pierces the back surface of the airtight container 1 and is supported by bearings 4 and 5 provided to the piercing section so that the shaft can freely rotate around the horizontal axis. The rotary shaft 3 is connected with a variable-speed motor 7 through a V-belt 6. A variable-speed circuit 8 for rotating the rotary drum 2 at a high speed and a low speed is connected with the variable-speed motor 7.

The outer peripheral wall of the rotary drum 2 is formed by a stainless steel plate provided with a number of punched holes 11 so that gas or liquid inside the airtight container 1 can freely circulate inside the rotary drum 2. The rotary drum 2 is supported in a cantilever state by the rotary shaft 3 which extends only in one direction from the rotary drum 2, and an end opposite to the rotary shaft is left open. A door 12 which can be opened and shut is provided to the airtight container 1 so as to face the open end of the rotary drum 2. A textile product to be treated is loaded into the rotary drum 2 by opening the door 12.

Figure 2:
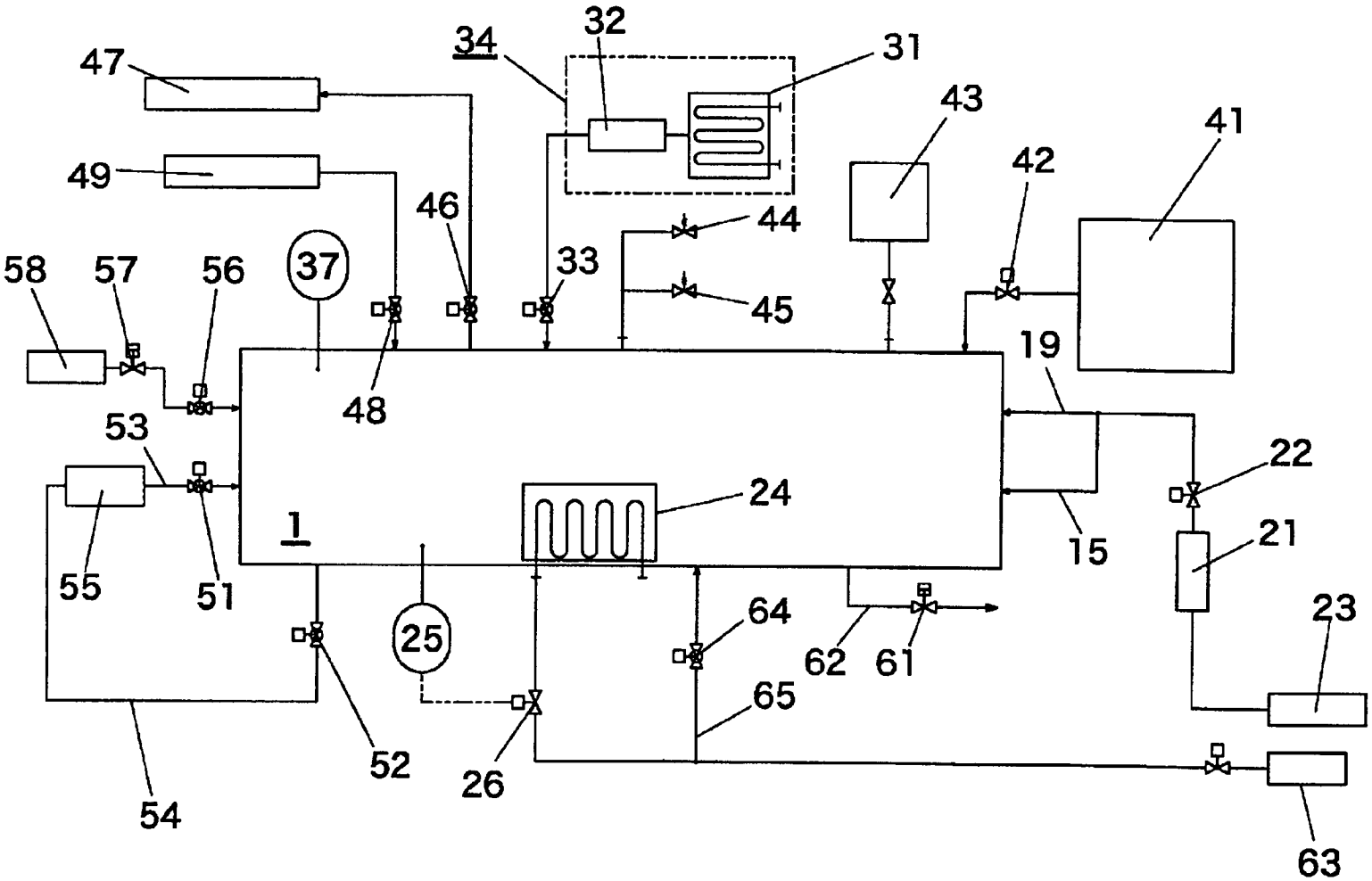
FIG. 2 is a block diagram showing the entire embodiment apparatus.

Two sealing materials 13 for sealing gas are provided on the rotary drum side of the bearings 4 and 5 which support the rotary shaft 3 of the rotary drum. A pressure-purging air pipe 15 which supplies pressurized air to a sealing chamber 14 partitioned by the two sealing materials is connected with the sealing chamber 14. A sealing material 16, which isolates the inside of the airtight container 1 from the outside when the door is closed, is in contact with an inner cylinder edge and an outer cylinder edge of a bi-cylindrical protrusion 17 provided at the periphery of the opening in the airtight container 1, and an air pipe 19 which supplies pressurized air for pressure purging to the space partitioned by the sealing material 16 is connected in the peripheral area of the door 12. As shown in FIG. 2, the pressure-purging air pipes 15 and 19 are connected with a compressed air source 23 through a pressure reducing valve 21 and a shut-off valve 22.

A liquid heater 24 is provided at the bottom of the airtight container 1. The liquid heater is a steam tube disposed inside the airtight container 1. In the case where a textile product to be decolorized is dyed in this apparatus, a dye solution inside the airtight container 1 is heated by causing steam to pass through the liquid heater 24 in a dyeing step. When warm water washing is performed after an ozone treatment, steam is also caused to pass through the liquid heater to maintain water inside the airtight container 1 at a desired temperature. The temperature of the dye solution or water inside the airtight container 1 is adjusted and maintained by allowing a controller to open and shut an automatic valve 26 based on the temperature detected by a liquid temperature sensor 25 provided at the bottom of the container.

A blower unit 34 including an air heater 31, a blower 32, and a shut-off gate 33 is provided at the top of the airtight container 1. Air discharged from the blower unit flows into the airtight container 1 through a diffusion chamber 36 which is provided with a diffusion wall 35 made of a punched metal at the interface with the airtight container 1. The temperature inside the airtight container 1 is adjusted and maintained by allowing a controller to adjust the amount of steam flowing through the air heater 31 by opening and shutting an automatic valve 38 based on the temperature detected by a gas temperature sensor 37 provided at the top of the container.

As shown in FIG. 2, a plurality of gas pipes and water pipes are connected with the airtight container 1. In FIG. 2, the airtight container 1 shown in FIG. 1 is illustrated as a simple rectangle, and the rotary drum and the door are omitted.

In FIG. 2, an ozone generator 41 communicates with the side wall of the airtight container 1 through an automatic valve 42. An ozone analyzer 43, a relief valve 44, and a vacuum breaker 45 are installed at the top of the airtight container 1. The blower unit 34 including the air heater 31, the blower 32, and the shut-off gate 33 is described above with reference to FIG. 1. An exhaust ozone disposal unit (ozone decomposition unit) 47 is connected to the top of the airtight container 1 through a shut-off valve 46, and an automatic chemical feeder 49 is connected through a shut-off valve 48. The gas temperature sensor 37 is described above with reference to FIG. 1.

A blower 55 is connected with the side and the bottom of the airtight container 1 through ducts 53 and 54 respectively equipped with shut-off valves 51 and 52. The blower circulates and stirs ozone-containing air inside the airtight container 1 in a decolorization step to make the ozone concentration inside the container uniform. A water supply unit 58 is connected with the side of the airtight container 1 through a water supply valve 56 and a flow control valve 57, and a water drain pipe 62 equipped with a water drain valve 61 is connected with the bottom of the airtight container 1.

The liquid heater 24, the liquid temperature sensor 25, and the automatic valve 26 are described above with reference to FIG. 1. A steam source 63 which supplies steam to the liquid heater 24 is connected with the inside of the airtight container 1 through a steam pipe 65 equipped with a shut-off valve 64.

Figure 3:
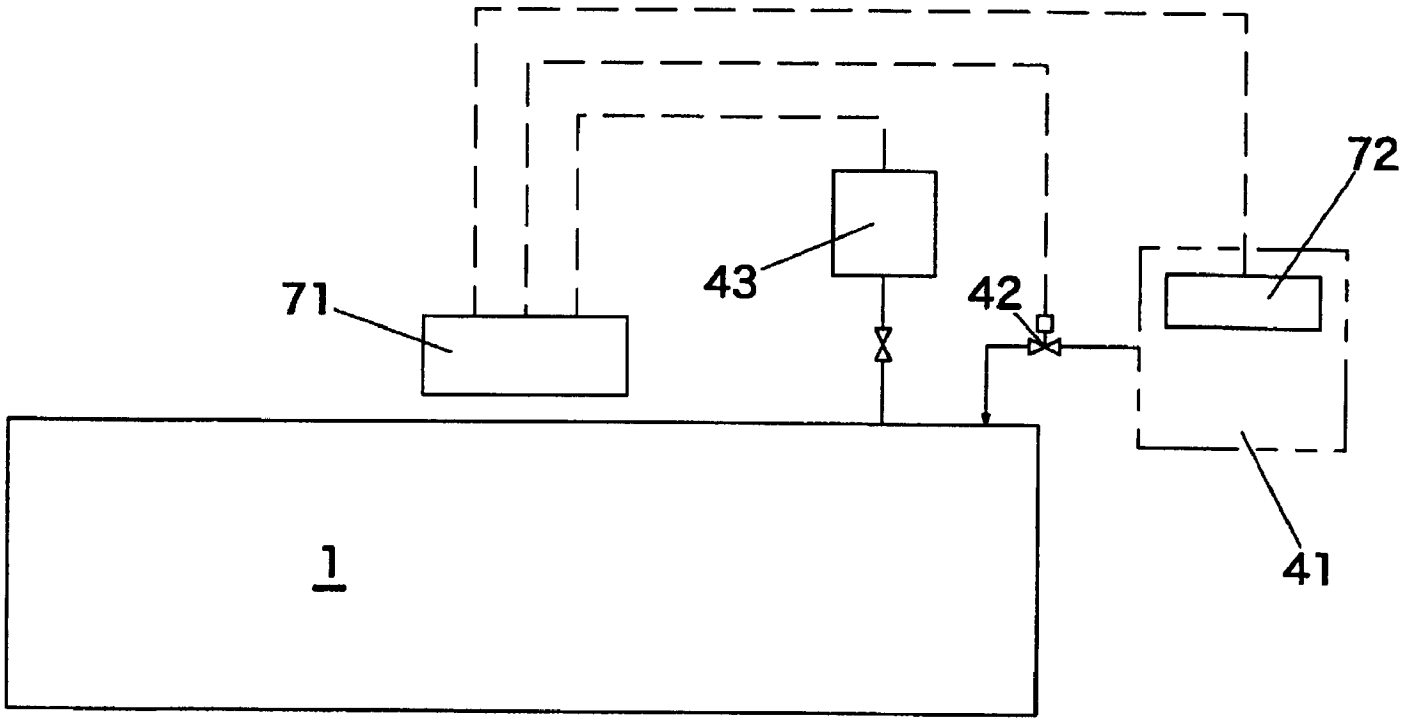
FIG. 3 is a block diagram showing only a control system of an ozone generator in the apparatus shown in FIG. 2.

FIG. 3 is a diagram illustrating only a control system of the ozone generator 41 in the apparatus shown in FIG. 2. The ozone concentration detected by the ozone analyzer 43 is transmitted to a controller 71 of the decolorization apparatus. The ozone concentration to be maintained inside the airtight container 1 during the decolorization step is set and recorded in the controller 71. The controller 71 determines the ozone concentration and the ozone feed rate based on the detected ozone concentration according to a control program registered in advance, and outputs an instruction for increasing or decreasing the ozone concentration and an instruction for opening or closing the valve. The instruction for increasing or decreasing the ozone concentration is transmitted to a controller 72 of the ozone generator 41, and the controller adjusts the concentration of ozone generated by controlling the discharge. The instruction for opening or closing the valve is transmitted to the automatic valve 42 to switch the ozone supply on and off.

Figure 4:
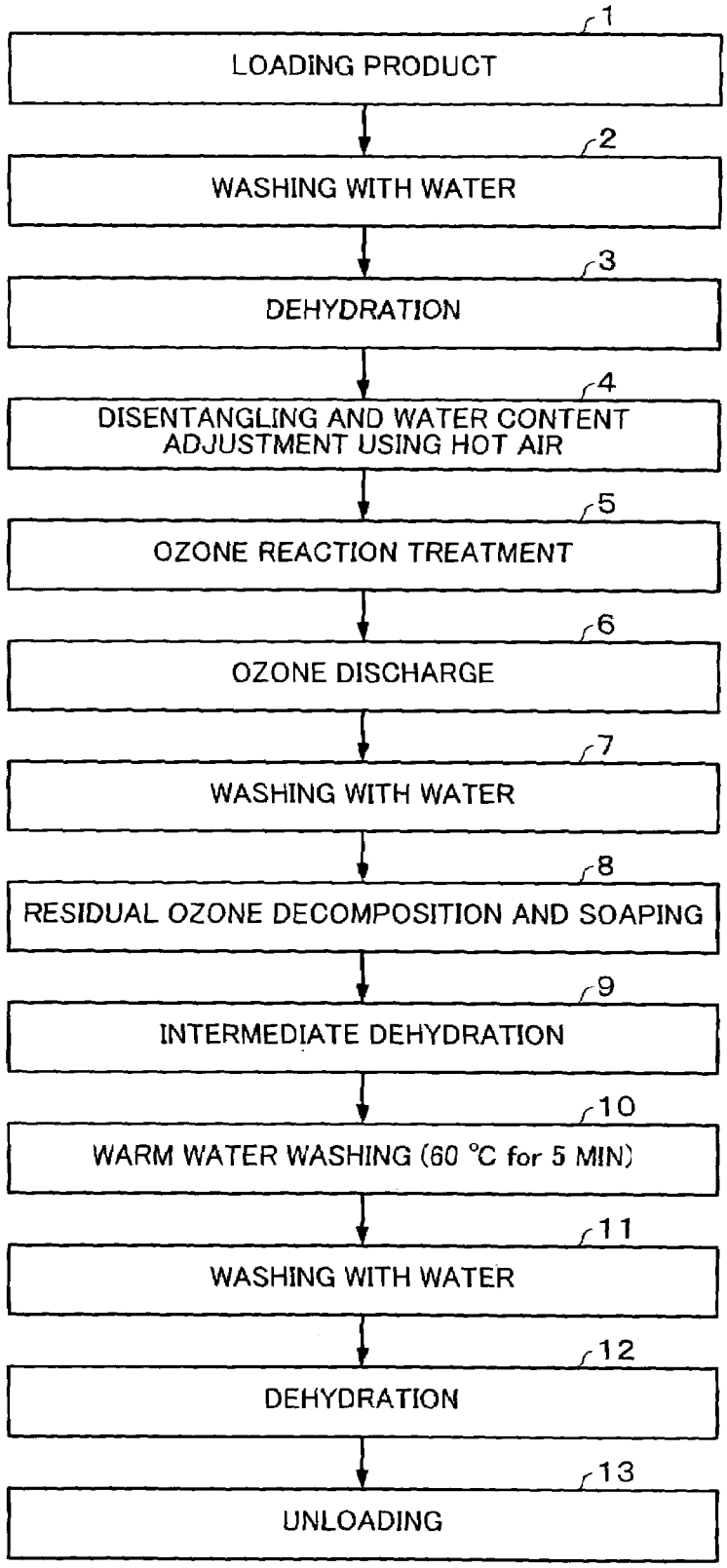
FIG. 4 is a flowchart which illustrates an operation of the embodiment apparatus.

The decolorization method for a textile product using the above-described embodiment apparatus is described below with reference to a flowchart shown in FIG. 4.

After opening the door 12 of the apparatus, a textile product to be treated (article such as jeans) is loaded into the rotary drum 2, and the door 12 is closed. The textile product is loaded in a wet or dry condition depending on the type or the difference in pretreatment. The capacity of the embodiment apparatus is such that about 160 pairs of jeans can be loaded at the same time.

After loading the article, the water supply valve 56 is opened to supply water to the airtight container 1, and the textile product is sufficiently wetted in a water-washing step by rotating the rotary drum 2 at a low speed for about 3 to 5 minutes. In the subsequent dehydration step, the water content of the textile product is adjusted by centrifugal dehydration by rotating the rotary drum 2 at a high speed. The dehydration time is about 10 minutes although it may vary depending on the type of textile product.

After the dehydration step, air heated by the air heater 31 is fed into the airtight container 1. The textile product is uniformly exposed to hot air while being disentangled by rotating the rotary drum 2 at a low speed and allowing the textile product to repeatedly fall through the heated air which flows inside the rotary drum 2, thereby adjusting the water content of the textile product to a desired level.

As a specific example, a semi-drying step is performed at a heated air temperature of 40° C. for 20 minutes, whereby the water content of the textile product which was nonuniform at the completion of the dehydration step is made uniform, and the water content of 80% immediately after the dehydration is adjusted to 50 to 60%. The degree of decolorization varies depending on the water content of the textile product. In the semi-drying step, the rotational speed and the reverse timing of the drum 2 are adjusted according to the type of textile product so that the textile product is uniformly exposed to hot air inside the rotary drum 2.

After the water content adjustment step, the container 1 is sealed by closing each operational valve, the rotary drum 2 is rotated at a low speed, and the shut-off valve 22 is opened to perform pressure purging over the shaft sealing section and the door sealing section. The ozone generator 41 is operated in this state, and the automatic valve 42 is opened to start injection of ozone gas into the airtight container 1. The degree of decolorization of the textile product is adjusted by the ozone concentration and the treatment time.

As a specific example, the treatment time is set at 30 to 60 minutes, ozone is injected until the ozone concentration inside the airtight container 1 reaches a predetermined concentration (5,000 to 15,000 ppm, for example), and the ozone injection is then temporarily stopped. Ozone is again injected when the ozone concentration inside the airtight container is reduced by the reaction to maintain the ozone concentration at a predetermined level during the treatment time.

In the ozone treatment step, the rotational speed and the reverse timing of the rotary drum 2 are adjusted corresponding to the type of textile product and a desired decolorization mode so that the textile product is sufficiently disentangled and uniformly exposed to the ozone gas inside the rotary drum 2. Then, the shut-off valves 51 and 52 are opened, and the blower 55 is driven to circulate the ozone-containing air inside the airtight container so that the ozone concentration inside the airtight container 1 becomes uniform. The treatment time is adjusted using a timer provided in the controller based on the type of textile product and a desired degree of decolorization.

When the ozone treatment step for a desired period of time has been completed, air is fed into the airtight container 1 by opening the shut-off gate 33 and operating the blower 32 to discharge the ozone inside the container to the exhaust ozone disposal unit 47 for decomposition. When the ozone concentration inside the container is reduced to a certain degree, water is fed into the container 1. The textile product is washed with water while rotating the rotary drum 2 at a low speed, and the ozone remaining in the textile product is decomposed by supplying warm water and a chemical.

An intermediate dehydration is then performed by rotating the rotary drum 2 at a high speed. After washing with warm water or cool water as required, the door 12 is opened and the treated textile product is removed from the container 1. The treatment time in each step is set using a timer for each step provided in the controller 71.

According to the apparatus of the embodiment of the present invention and the method of the embodiment of the present invention using the apparatus, a dyed textile product can be partially or uniformly decolorized. The degree of decolorization can be easily adjusted by the degree of dehydration or drying in the water content adjustment step and the ozone concentration inside the airtight container or the treatment time in the ozone decolorization step. The uniformity of decolorization can be adjusted by partially adjusting the water content of the textile product by the rotational speed of the rotary drum in the centrifugal dehydration step or periodical stoppages of the rotation of the rotary drum in the semi-drying step. Moreover, since uniform decolorization at a desired thickness can be achieved, a textile product can be easily provided with a decolorization pattern with a desired shape and thickness by intentionally providing moisture to a decolorization target section using a spray nozzle or the like after the water content adjustment step. Furthermore, the apparatus of the present invention enables the textile product to be dyed as a step preceding the decolorization in a single apparatus, whereby the dye treatment and the decolorization be continuously performed.

What is claimed is:

1. A decolorization apparatus for a textile product, comprising:

an airtight container;

a rotary drum which has a water-permeable peripheral wall and rotates around a horizontal axis inside the airtight container;

a door provided to the airtight container for loading a textile product into the rotary drum;

an ozone generator connected with the airtight container through an automatic valve;

a water supply unit which supplies water to the airtight container;

a blower unit which is provided outside the airtight container, includes an air heater, and supplies hot air and cool air to the airtight container; and a blower which is provided outside the airtight container, circulates, and stirs ozone-containing air inside the airtight container.

2. The decolorization apparatus for a textile product according to claim 1 further comprising:

a shaft support for supporting the rotary drum; and an air pipe for supplying compressed air for pressure purging on the door and the shaft support.

3. A decolorization apparatus for a textile product, comprising:

an airtight container;

a rotary drum which has a water-permeable peripheral wall and rotates around a horizontal axis inside the airtight container;

a door provided to the airtight container for loading a textile product into the rotary drum;

an ozone generator connected with the airtight container through an automatic valve;

a water supply unit which supplies water to the airtight container;

a blower unit which includes an air heater and supplies hot air and cool air to the airtight container; and air pipes which supply compressed air for pressure purging on the door and a shaft support of the rotary drum.

4. A decolorization method for a textile product, comprising:

a loading step of loading a textile product into a rotary drum and closing a door by using an apparatus which includes an airtight container and the rotary drum, the airtight container having the door and the rotary drum having a water-permeable peripheral wall and rotating around a horizontal axis in the airtight container;

a centrifugal dehydration step of rotating the rotary drum at a high speed;

an ozone decolorization step of circulating and stirring ozone gas inside the airtight container and rotating the rotary drum at a low speed, thereby exposing the textile product to the ozone gas to decolorize the textile product;

an ozone discharging step of discharging the ozone gas by supplying air to the airtight container;

an ozone decomposition step of dissolving the ozone gas remaining in the textile product by supplying water to the airtight container; and a post-treatment washing step of washing the textile product with water and dehydrating the textile product.

5. The decolorization method according to claim 4, comprising a dyeing step of supplying a dye solution to the airtight container and rotating the rotary drum for a predetermined period of time, between the loading step and the centrifugal dehydration step.

6. The decolorization method according to claim 5, wherein, in the ozone decomposition step, a chemical which decomposes ozone is supplied to the airtight container together with water.

7. The decolorization method according to claim 4, wherein, in the ozone decomposition step, a chemical which decomposes ozone is supplied to the airtight container together with water.

8. The decolorization method for a textile product according to claim 4, wherein, in the decolorization step, compressed air is purged on one of the door and a shaft of the rotary drum.

* * * * *